US006672397B2

(12) United States Patent
Taylor

(10) Patent No.: US 6,672,397 B2
(45) Date of Patent: Jan. 6, 2004

(54) BREATHABLE FIRE CONTROL SYSTEM

(76) Inventor: Timothy Nathaniel Taylor, 258 Newman springs Rd., Red Bank, NJ (US) 07701

( * ) Notice: Subject to any disclaimer, the term of this patent is extended or adjusted under 35 U.S.C. 154(b) by 0 days.

(21) Appl. No.: 10/206,325

(22) Filed: Jul. 29, 2002

(65) Prior Publication Data

US 2002/0185283 A1 Dec. 12, 2002

Related U.S. Application Data

(63) Continuation-in-part of application No. 09/553,801, filed on Apr. 21, 2000, now abandoned.

(51) Int. Cl.[7] ..... A62C 35/00
(52) U.S. Cl. ..... 169/12; 169/45; 252/605
(58) Field of Search ..... 169/12, 11, 45, 169/46, 60, 66, 84; 252/605

(56) References Cited

U.S. PATENT DOCUMENTS

| | | | | | |
|---|---|---|---|---|---|
| 716,381 | A | * | 12/1902 | Clayton | 169/12 |
| 1,254,582 | A | * | 1/1918 | Decker | 169/12 |
| 1,406,479 | A | * | 2/1922 | Muchka | 252/372 |
| 2,051,125 | A | * | 8/1936 | Bacon | 169/12 |
| 2,091,197 | A | * | 8/1937 | Edmundson | 169/12 |
| 3,438,445 | A | * | 4/1969 | MacCracken | 169/44 |
| 3,486,562 | A | * | 12/1969 | Goodloe et al. | 169/11 |
| 3,715,438 | A | * | 2/1973 | Huggett | 514/771 |
| 3,822,207 | A | * | 7/1974 | Carhart et al. | 252/8 |
| 3,840,667 | A | | 10/1974 | Huggett | |
| 3,893,514 | A | * | 7/1975 | Carhart et al. | 169/46 |
| 4,311,198 | A | | 1/1982 | Vasquez | |
| 4,446,923 | A | * | 5/1984 | Martin | 169/45 |
| 4,678,041 | A | | 7/1987 | Staudinger | |
| 4,807,706 | A | | 2/1989 | Lambertsen et al. | |
| 5,501,284 | A | | 3/1996 | Clodfelter et al. | |
| 5,957,210 | A | | 9/1999 | Cohrt et al. | |
| 6,401,487 | B1 | * | 6/2002 | Kotliar | 62/640 |
| 6,502,421 | B2 | * | 1/2003 | Kotliar | 62/640 |
| 6,557,374 | B2 | * | 5/2003 | Kotliar | 62/640 |
| 6,560,991 | B1 | * | 5/2003 | Kotliar | 62/640 |

* cited by examiner

*Primary Examiner*—Michael Mar
*Assistant Examiner*—Thach H. Bui
(74) *Attorney, Agent, or Firm*—Siemens Patent Services, LC

(57) ABSTRACT

The present invention features a portable, modular on-site breathable fire control system which can make an unlimited amount of cooled, oxygen-depleted air that can still be consumed by humans while extinguishing fire and reducing smoke. This system may be incorporated into an already existing heating and A/C unit for enhanced fire safety in a home or building. The system may also be used as a mobile unit attached to a fire safety vehicle wherein a transmission conduit transfers the processed air directly to the area on fire. Additionally, a fire-resistant tarp-like structure of sufficient size may be used to enclose a burning structure while the process air is transmitted thereto via a transmission conduit.

19 Claims, 6 Drawing Sheets

BREATHABLE FIRE CONTROL SYSTEM

RELATED APPLICATION

This patent application is a continuation-in-part of U.S. patent application Ser. No. 09/553,801, filed Apr. 21, 2000 now abn.

BACKGROUND OF THE INVENTION

1. Field of the Invention

The present invention relates to the prevention, control and extinguishing of fires in confined spaces and, more particularly, to the control and extinguishing of fires while facilitating safety for personnel activity during an emergency.

2. Discussion of the Prior Art

The prior art is replete with solving the problems of extinguishing fires in confined spaces where mammalian life, and in particular, human life is present. As is well known to those in the art, fires are supported by oxygen and that by using some means to deplete the surrounding area of oxygen or lowering the percentage of oxygen will result in the fire being extinguished. Therefore, the solutions, as taught by the prior art, revolve around producing a habitable, yet combustion suppressant atmosphere in the confined area.

Cohrt et al discloses the use of an inert fire fighting gas, in U.S. Pat. No. 5,501,284, (Nov. 28, 1999) for fighting fire in an enclosed space. Cohrt et al teach of producing this gas by a reaction of ammonia mixed with atmospheric air to produce nitrogen mixed with water vapor. The fire fighting mixture is produced in a small gas turbine having a combustion chamber into which the ammonia, in liquid form, is sprayed along with water. The resultant gas is used to fight fire.

Vasquez discloses a smoke removal apparatus, in U.S. Pat. No. 4,311,198, issued Jan. 19, 1982, with suction or blowing and directional discharge options. Respective first and second conduits are connected alternatively with the suction and discharge side of the suction-blower unit for removing the smoke. An inert gas injection mechanism is provided in conjunction with the suction-blower unit for replacing the smoke with an inert gas to squelch combustion.

Lambertsen et al discloses Breathable Fire Extinguishing Gas Mixtures in U.S. Pat. No. 4,807,706, issued Feb. 28, 1989, for a process for safely preventing, controlling and/or extinguishing fires in confined spaces by introducing carbon dioxide and other inter gasses, such as nitrogen and helium to lower the oxygen content to a concentration in the range between 8% and 15% by volume while increasing the carbon dioxide content of the confined space to an amount in the range of 2% to 5% by volume. The combination of reducing oxygen concentration and increasing carbon dioxide concentration in the gaseous environment of the confined area works together to sustain human life while extinguishing flames.

The U.S. Pat. No. 3,893,514, to Carhart et al, issued Jul. 8, 1975, discloses a process for suppressing fires in confined spaces by adding nitrogen to the area to increase the total gaseous pressure of oxygen in the area at a level that will not support combustion.

The U.S. Pat. No. 3,840,667, issued to Huggett, Oct. 8, 1974 discloses an oxygen-containing atmospheres. Theses mixtures contain oxygen, polyatomic gases having a high heat capacity, and helium.

None of these patents either teaches or suggests the on-site breathable fire control system which can make an unlimited amount of cooled, oxygen-depleted air that can still be consumed by humans while extinguishing fire and reducing smoke.

SUMMARY OF THE INVENTION

The present invention features a portable, modular, on-site, breathable fire control system which can make an unlimited amount of cooled, oxygen-depleted air that can still be consumed by humans while extinguishing fire and reducing smoke. This system may be incorporated into an already existing heating, ventilation, and air conditioning (HVAC) unit for enhanced fire safety in a home or building. The system may also be used as a mobile unit attached to a fire safety vehicle wherein a transmission conduit transfers the processed air directly to the area on fire. Additionally, a fire-resistant tarp-like structure of sufficient size may be used to enclose a burning structure while the processed air is transmitted thereto via a transmission conduit.

It is therefore an object of the invention to provide a breathable fire control system and process for safely controlling and extinguishing fires in confined spaces without damage to equipment.

It is another object of the invention to provide a breathable fire control system and process for safely controlling and extinguishing fires in confined spaces without loss of habitability for personnel.

It is also an object of the invention to provide a a breathable fire control system and process for safely controlling and extinguishing fires in confined spaces without loss of consciousness for personnel or significant impact on the mental acuity of personnel in the confined space.

It is a further object of the invention to provide a breathable fire control system and process for safely controlling and extinguishing fires in confined spaces that is economical.

It is an additional object of the invention to provide a breathable fire control system and process for safely controlling and extinguishing fires in confined spaces utilizing pressurization of a building to prohibit further fire growth.

It is a still further object of the invention to provide a breathable fire control system and process for safely controlling and extinguishing fires in confined spaces employing external pressurization techniques.

It is a still further object of the invention to provide a breathable fire control system and process for safely controlling and extinguishing fires in confined spaces by creating habitable, extinguishing air in almost unlimited amounts at the scene of the fire.

It is a still further object of the invention to provide a breathable fire control system and process that employs normal air leaving no room for harmful amounts of impurities, such as carbon monoxide.

These and other objects, features and advantages will be more apparent from a study of the enclosed text and the appended drawings.

BRIEF DESCRIPTION OF THE DRAWINGS

A complete understanding of the present invention may be obtained by reference to the accompanying drawings, when taken in conjunction with the detail description thereof and in which.

DESCRIPTION OF THE PREFERRED EMBODIMENT

This disclosure of the invention is submitted in furtherance of the constitutional purposes of the U.S. Patent Laws "to promote the progress of science and useful arts" (Article 1, Section 8).

Generally speaking this invention relates to the prevention, control and extinguishing of fires in confined spaces. The disclosed breathable fire safety control device, shown as 1000 in the appended figures, facilitates safety during an emergency by reducing harmful smoke gases while aiding to extinguish fires in an enclosed space. Since it is known that the air we breath consists of two major types of gases, nitrogen (at about 78%) and Oxygen (at about 21%), a device and method that uses oxygen reduced air to extinguish fire is described herein.

Figure 1A:
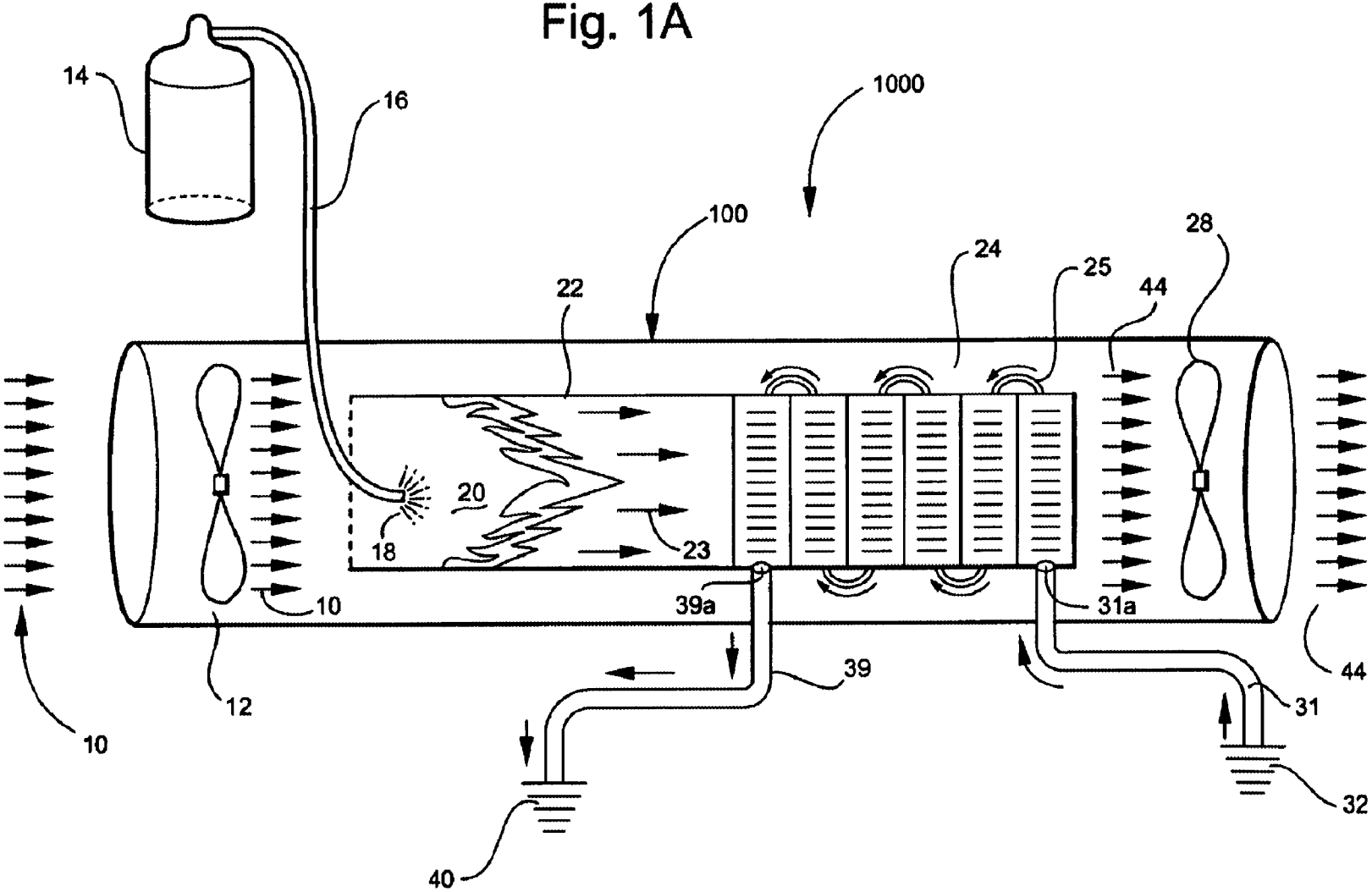
FIG. 1A is a diagrammatic view of the inventive breathable fire control system employing external, continuous cooling features.
Figure 1B:
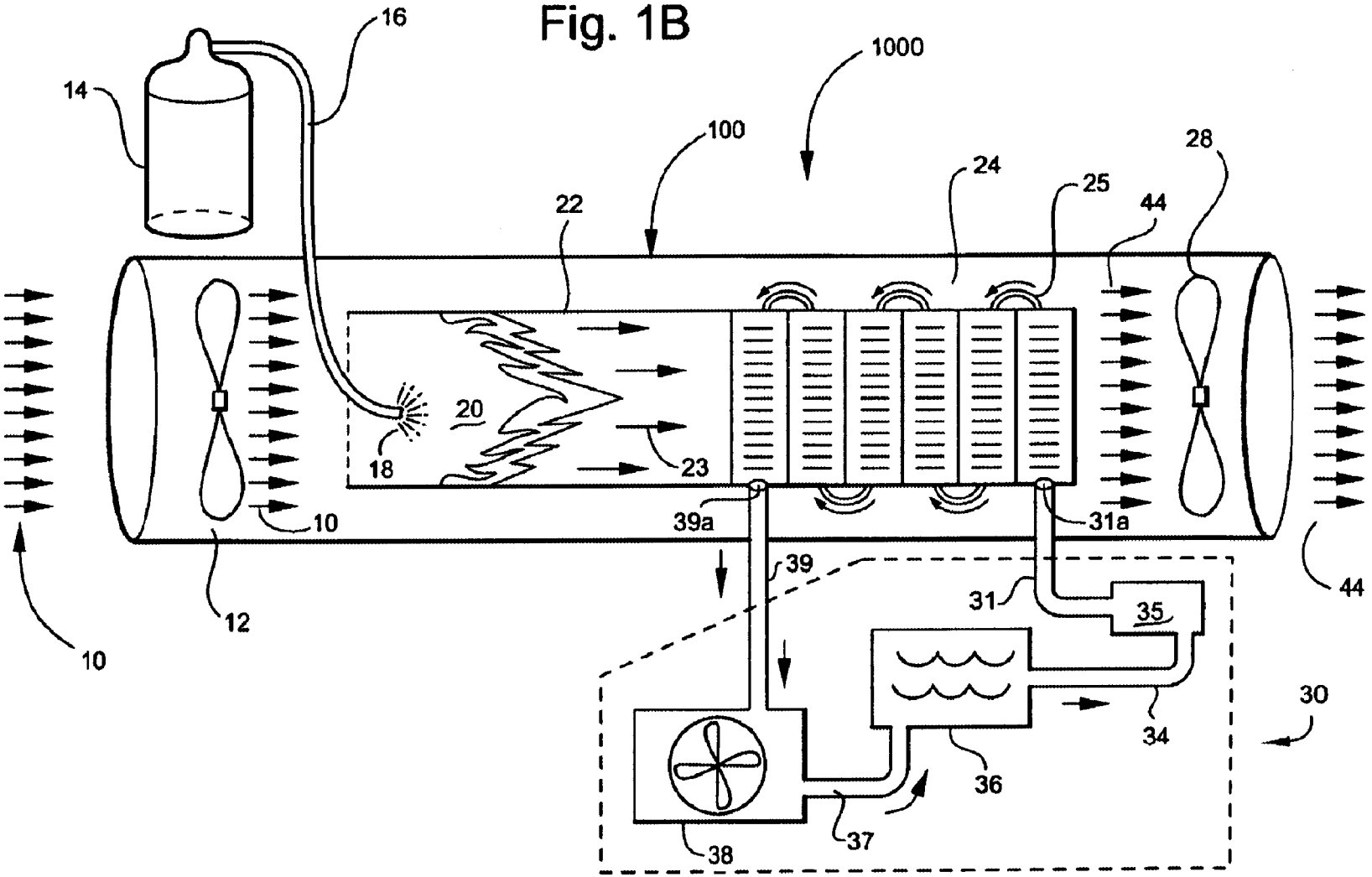
FIG. 1B is a diagrammatic view of the inventive breathable fire control system employing internal, closed loop cooling features.
Figure 1C:
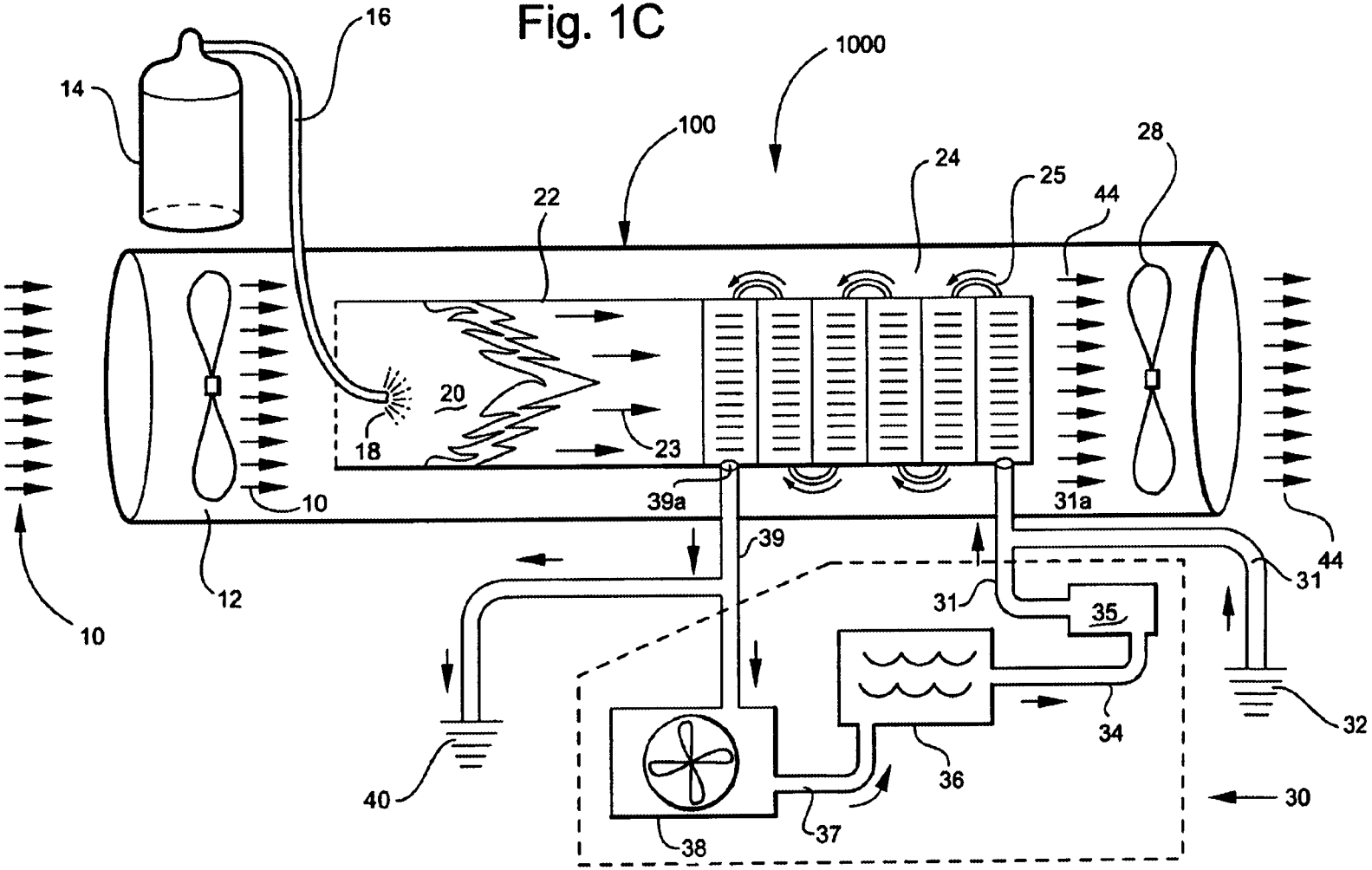
FIG. 1C is a diagrammatic view of the inventive breathable fire control system with combined cooling features.

As shown in FIGS. 1A, 1B, and 1C the inventive fire safety control system 1000 receives unprocessed air 10 from the atmosphere, treats the air 10 within the device 1000 and releases cooled, oxygen-reduced air 44 (termed CORA hereinafter). As can be gleaned from the above mentioned figures, unprocessed air 10 from the atmosphere enters the housing 100 of the system 100 with the aid of flow currents created by input fan 12. Housing 1000 contains the major components of the system 1000, including the input and output fans (12 and 28, respectively), the gas combustion chamber 22, and a series of air cooling radiators 24.

The input fan 12 then forces the air 10 into a gas combustion chamber 22. The combustion chamber 22 receives a flammable gas contained in an external gas source such as a gas tank 14. The flammable gas is delivered to the chamber 22 by way of a fuel line 16 coupled at one end to the chamber 22 and at the other end to the tank 14. Once the gas enters the chamber 22, a gas valve 18 creates a spark which in turn produces a controlled gas flame 20 within the chamber 22.

Any suitable flammable gas known in the art such as propane, or methane, for example, may be stored inside tank 14. The process of the burning flame 20 inside of chamber 22 reduces the oxygen $\{O_2\}$ content of the air 10. The $O_2$ is consumed in the combustion process and lowers the oxygen content to within a range of 12% to 15% to thereby produce oxygen reduced air 23. Although lowering the oxygen level of air below 12% would make it increasingly more effective for fire control, the air becomes less breathable which would not be desirable for fire-fighting personnel.

The oxygen reduced air 23 must then be cooled from about 1000° F. down to about 90° F. The process of cooling the oxygen reduced air 23 is performed by a series of air cooling radiators 24. Oxygen reduced air 23 enters the radiators 24 and is forced through the radiators 24 by way of negative air pressure created by the flow from input fan 12 and the output fan 28. The input and output fans, 12 and 28, respectively, are configured such that 100,000 cubic feet of air per minute is forced in and out of the system 1000. The average household room contains roughly one thousand cubic feet of air, thus this system 1000 can fill an average room with CORA 44 several times within a few minutes.

A cooling fluid is circulated through the air cooling radiators 24 by way of pipes 25. The radiators 24 reduce the temperature of the oxygen reduced air 23, thereby producing CORA 44. Output fan 28 then forces this CORA 44 out of the system 1000 thereby providing breathable, cooled, oxygen-reduced air, CORA 44 for use against flames. Herein, over 99% of the extinguishing gas CORA 44 is normal air, leaving no room for harmful amounts of impurities such as carbon monoxide, thus enhancing the safety for any fire-fighting personnel. Several ways of cooling the fluid circulating through the radiators may be employed, as described below.

In FIG. 1A, the fire safety control system 1000 employs the use of an external cooling fluid, such as water. Piping 31 connected to an external water source 31 transfers water into an input duct 31*a*, which allows cooling fluid to enter the series of air cooling radiators 24. As the oxygen-reduced air 23 is cooled within the radiators 24, the cooling fluid exits the radiators 24 at an output duct 39*a*. The output duct 39*a* is coupled to piping 39 to allow cooling fluid to exit to an external drainage means 40. Herein, pipings 31 and 39 along with water source 32 and drainage means 40 provide an open-ended provision for external cooling fluid circulation. Such open-ended cooling may be easily adapted for use with a home or building connected to public water supply or ground water supply.

FIG. 1B illustrates a closed-loop circulation of cooling fluid that is transferred from a cooling unit 30 to air cooling radiators 24. A coolant reservoir 36 houses a suitable coolant known in the art, such as but not limited to glycol alcohol or water, for example. The coolant fluid is then transferred by way of piping 34 to a fluid pump 35. Fluid pump 35 pumps coolant fluid into the air cooling radiators 24 through input duct 31*a*. After circulating through the series of radiators 24, the coolant fluid then exits through output duct 39*a* to piping 39 into a fluid cooling radiator device 38.

This cooling radiator device 38 significantly cools the coolant fluid and this cooled fluid is transferred by way of piping 37 into the coolant reservoir 36. The fluid pump 35 provides the appropriate force to circulate the coolant fluid throughout the cooling unit 30.

FIG. 1C shows an embodiment employing both a cooling unit 30 in conjunction with external water source 32 and drainage means 40. In such an embodiment, the coolant fluid may be water taken from the external water source 32 that is cooled by the cooling unit 30, as described above. After a fire control process is completed, the circulated water may be removed by way of piping 39 out to external drainage means 40.

Figure 2:
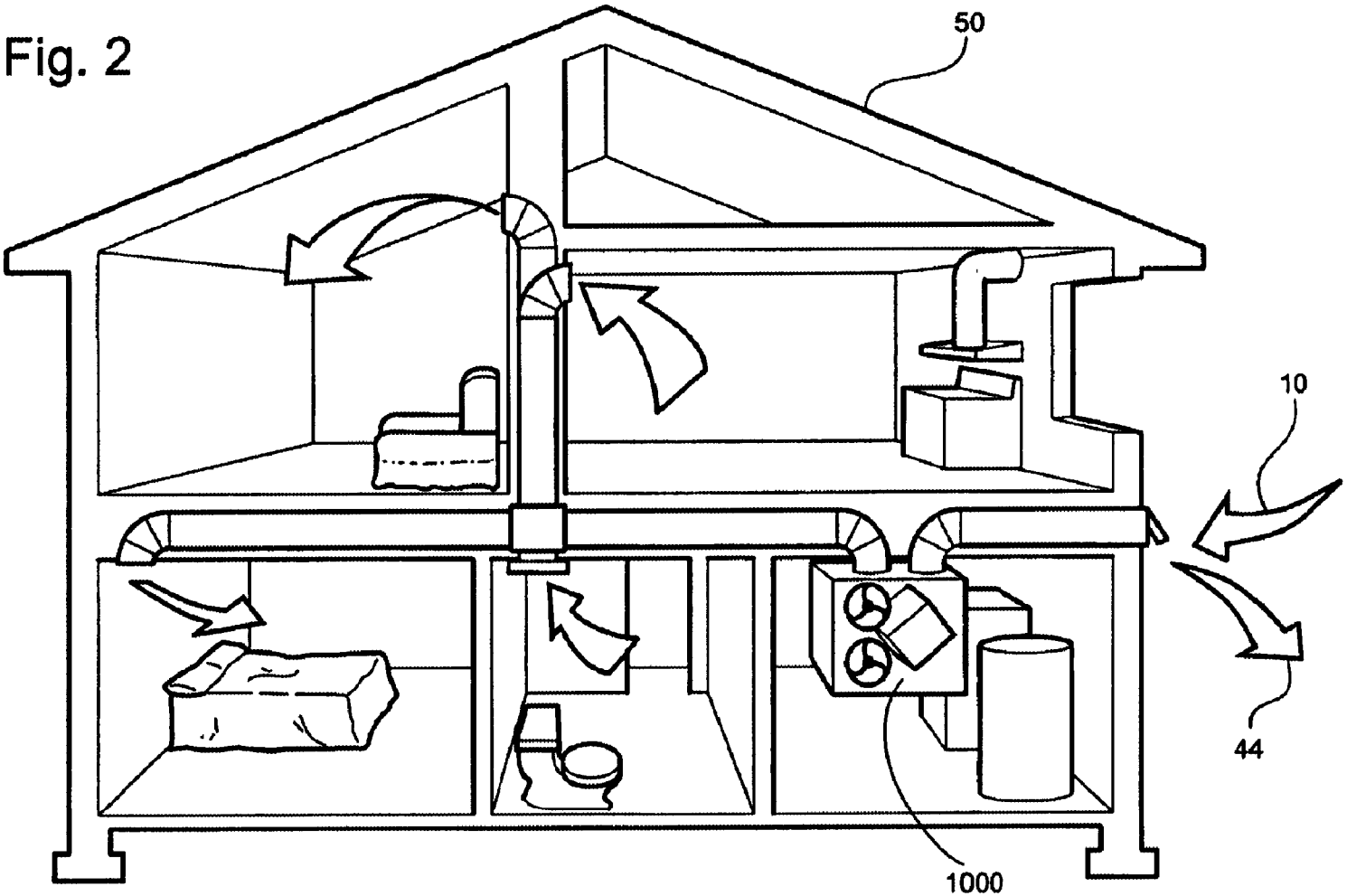
FIG. 2 is a building section illustrating operation of the inventive breathable fire control system incorporated into a climate control system of a house (or building), in accordance with the present invention.

FIG. 2 illustrates the present invention as used within a housing structure 50 such as a home or building environment. Herein, the fire safety control device 1000 may be incorporated into a climate control system such as a heating and air conditioning unit. Herein, CORA 44 is circulated to cover every cubic inch of interior space traveling throughout the internal conduits between walls and exiting vents. At the onset of a fire or excessive smoke, the system 1000 can be configured to automatically turn on and begin the processing of air. The system may be hard-wired to a smoke detector (not shown) which may trigger the system 1000 to start. Such a smoke detector may be incorporated into a modified HVAC.

Upon prompted operation of the fire control system 1000, external unprocessed air 10 from the atmosphere 10 is brought into the system 1000 and processed (as described above). The system 1000 outputs CORA 44 which is then circulated throughout the structure 50 by the HVAC system. An alternate power source, such as, for example, a battery or generator, may be used in the event that the normal power of the structure 50 becomes unavailable due to fire.

The HVAC unit also has provisions to output the dangerous, hot, smoke-filled air 48 out of the structure 50. In the event of an inception of a fire, the modified HVAC is configured with appropriate hardware and/or software to begin circulating CORA 44 within structure 50. These provisions may also include additional conduits and ducts (not shown) adapted to the structure 50 and incorporated into the HVAC system to expel the hot, smoke-filled air 48 away from structure 50.

Figure 3:
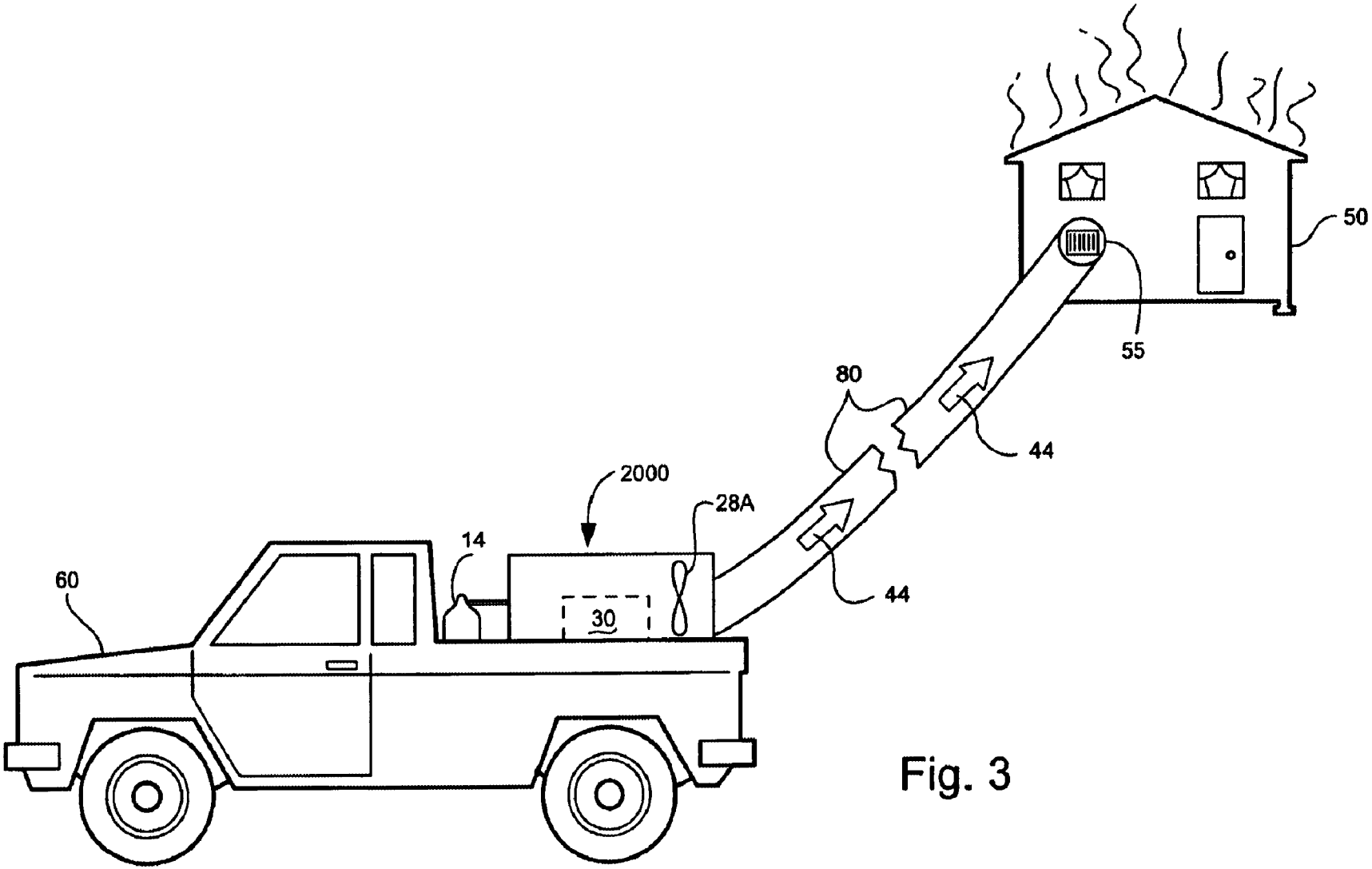
FIG. 3 shows an alternate embodiment of the fire safety control system used in conjunction with a fire safety control vehicle and a transmission conduit, in accordance with the present invention.

FIG. 3 shows an embodiment of the fire safety control system 2000 in use as a mobile unit. Herein, a fire safety vehicle 60 houses the system 2000. The mobile system 2000 is connected to gas tank 14 and cooling means, such as a cooling unit 30, or external water and drainage sources. Attached to the system 2000 is a CORA transmission conduit 80 which transfers CORA 44 to a housing structure 50 on fire.

In the instant embodiment, a hyper-powered output fan 28A may be employed to sufficiently force CORA 44 through conduit 80 onto a burning structure 50. The conduit 80 may be attached to any existing window or hole in the structure 50. Or alternatively may be attached directly to a vent 55 to force CORA 44 through the heating and A/C conduits within a structure 50 in a strategic manner.

Figure 4:
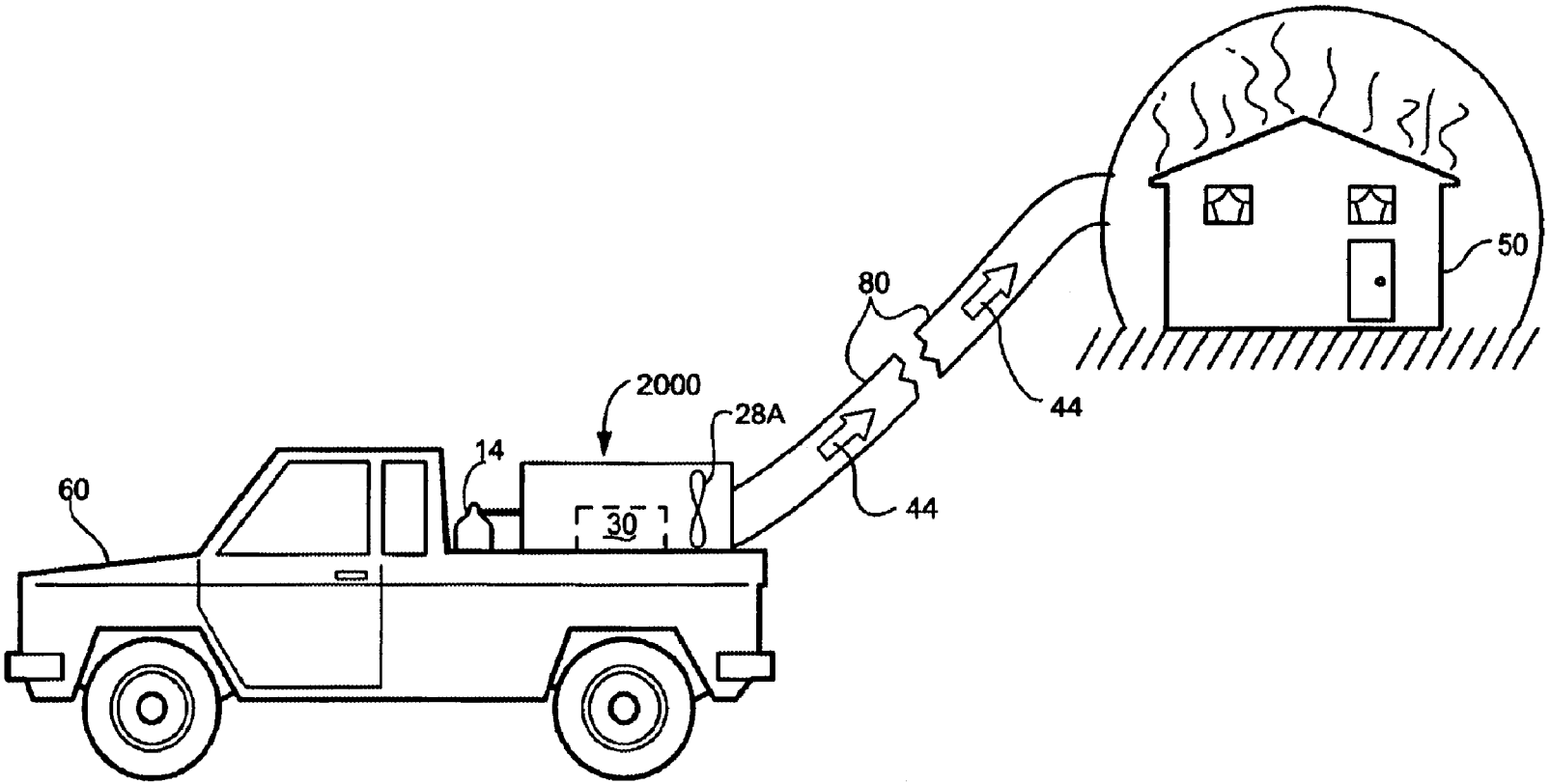
FIG. 4 shows an alternate embodiment of the fire safety control system used in conjunction with a fire safety vehicle and an enclosing device for physically containing the fire, in accordance with the present invention.

FIG. 4 shows another embodiment employing the fire control system 2000 as a mobile unit in conjunction with a fire safety vehicle 60. However, in this embodiment, a fire-resistant tarp 85 is connected to CORA transmission conduit 80 to encircle a burning structure 50. Tarp 85 may be fire-retarded in several ways, including having layers of internal materials coated or impregnated with substances which deter fire. However, tarp 85 is not intended to be a limiting, definite structure, but rather an exemplary device illustrating an enclosing means that can surround a burning structure 50.

Since other modifications and changes varied to fit particular operating requirements and environment will be apparent to those skilled in the art, the invention is not considered limited to the example chosen for purposes of disclosure, and covers all changes and modifications which do not constitute a departure from the true spirit and scope of the invention.

Having thus described the invention, what is desired to be protected by Letters Patent is presented in the subsequent appended claims.

What is claimed is:

1. A portable, breathable fire control system for extinguishing flames and reducing smoke in a burning structure, said system comprising:

a) a housing, said housing adapted to receive external, unprocessed air from the atmosphere, said housing having contained therein 1) an input fan 2) a gas combustion chamber operably connected to said input fan for receiving said external unprocessed air, 3) a series of radiators coupled to said combustion chamber, 4) an output fan for disposing cooled, oxygen-reduced air out of the system to extinguish flames and reduce smoke, b) gas tank means for containing flammable fuel, said gas tank means having fuel transmission means connected thereto and coupled to said gas combustion chamber, for transmitting fuel from said tank to said gas combustion chamber, c) fluid cooling means for circulating cooled fluid through said series of radiators to significantly lower air temperature of said oxygen-reduced air.

2. A portable breathable fire control system for extinguishing flames and reducing smoke in a building, as in claim 1, wherein said input fan is configured to maintain airflow at a steady input rate.

3. A portable breathable fire control system for extinguishing flames and reducing smoke in a building, as in claim 2, wherein said gas combustion chamber has a gas valve means coupled to said fuel transmission means for releasing flammable gas from said gas tank means to ignite a flame within said chamber, said flame transforming unprocessed air into oxygen-reduced air.

4. A portable breathable fire control system for extinguishing flames and reducing smoke in a building, as in claim 3 wherein said fluid cooling means comprises a cooling unit, said cooling unit having a) a coolant radiator, b) a coolant reservoir, and c) a coolant pump.

5. A portable breathable fire control system for extinguishing flames and reducing smoke in a building, as in claim 3 wherein said fluid cooling means comprises water inlet conduits and water drainage conduits, said water inlet conduits coupled to both said radiators and to an external water source, said water drainage conduits coupled to both the said radiators and to an external water drainage.

6. A portable breathable fire control system for extinguishing flames and reducing smoke in a building, as in claim 3 wherein, said fluid cooling means comprises a cooling unit said cooling unit having a) a coolant radiator, b) a coolant reservoir, and c) a coolant pump;

said cooling unit coupled on one end to a water inlet conduit and on another end to a water drainage conduit.

7. A portable, breathable fire control system for extinguishing flames and reducing smoke in a burning structure, said system comprising:

a) a housing, said housing adapted to receive external, unprocessed air from the atmosphere, said housing having contained therein 1) an input fan 2) a gas combustion chamber operably connected to said input fan for receiving said external, unprocessed air, 3) a series of radiators coupled to said combustion chamber, 4) an output fan for disposing cooled, oxygen-reduced air out of the system to extinguish flames and reduce smoke, b) gas tank means for containing flammable fuel, said gas tank means having fuel transmission means connected thereto and coupled to said gas combustion chamber, for transmitting fuel from said tank to said gas combustion chamber, c) fluid cooling means for circulating cooled fluid through said series of radiators to significantly lower air temperature of said oxygen-reduced air;

said housing having attached thereto a transmission conduit adapted to transfer cooled, oxygen reduced air from said system to said burning structure.

8. A portable breathable fire control system for extinguishing flames and reducing smoke in a building, as in claim 7, wherein said input fan is configured to maintain airflow at a steady input rate.

9. A portable breathable fire control system for extinguishing flames and reducing smoke in a building, as in claim 8, wherein said gas combustion chamber has a gas valve means coupled to said fuel transmission means for releasing flammable gas from said gas tank means to ignite a flame within said chamber, said flame transforming unprocessed air into oxygen-reduced air.

10. A portable breathable fire control system for extinguishing flames and reducing smoke in a building, as in claim 9 wherein said fluid cooling means comprises a cooling unit, said cooling unit having a) a coolant radiator, b) a coolant reservoir, and c) a coolant pump.

11. A portable breathable fire control system for extinguishing flames and reducing smoke in a building, as in claim 9 wherein said fluid cooling means comprises water inlet conduits and water drainage conduits, said water inlet conduits coupled to both said radiators and to an external water source, said water drainage conduits coupled to both the said radiators and to an external water drainage.

12. A portable breathable fire control system for extinguishing flames and reducing smoke in a building, as in claim 9 wherein, said fluid cooling means comprises a cooling unit said cooling unit having a) a coolant radiator, b) a coolant reservoir, and c) a coolant pump;

said cooling unit coupled on one end to a water inlet conduit and on another end to a water drainage conduit.

13. A portable, breathable fire control system for extinguishing flames and reducing smoke in a burning structure, said system comprising:

a) a housing, said housing adapted to receive external unprocessed air from the atmosphere, said housing having contained therein 1) an input fan 2) a gas combustion chamber operably connected to said input fan for receiving said external, unprocessed air, 3) a series of radiators coupled to said combustion chamber, 4) an output fan for disposing cooled, oxygen-reduced air out of the system to extinguish flames and reduce smoke, b) gas tank means for containing flammable fuel, said gas tank means having fuel transmission means connected thereto and coupled to said gas combustion chamber, for transmitting fuel from said tank to said gas combustion chamber, c) fluid cooling means for circulating cooled fluid through said series of radiators to significantly lower air temperature of said oxygen-reduced air;

said housing having attached thereto a transmission conduit adapted to transfer cooled, oxygen reduced air from said system to said burning structure;

enclosure means for surrounding said burning structure, said enclosure means coupled to said transmission conduit.

14. A portable breathable fire control system for extinguishing flames and reducing smoke in a building, as in claim 13, wherein said enclosure means comprises a fire-resistant tarp-like structure.

15. A portable breathable fire control system for extinguishing flames and reducing smoke in a building, as in claim 14, wherein said input fan is configured to maintain airflow at a steady input rate.

16. A portable breathable fire control system for extinguishing flames and reducing smoke in a building, as in claim 15, wherein said gas combustion chamber has a gas valve means coupled to said fuel transmission means for releasing flammable gas from said gas tank means to ignite a flame within said chamber, said flame transforming unprocessed air into oxygen-reduced air.

17. A portable breathable fire control system for extinguishing flames and reducing smoke in a building, as in claim 16 wherein said fluid cooling means comprises a cooling unit, said cooling unit having a) a coolant radiator, b) a coolant reservoir, and c) a coolant pump.

18. A portable breathable fire control system for extinguishing flames and reducing smoke in a building, as in claim 16 wherein said fluid cooling means comprises water inlet conduits and water drainage conduits, said water inlet conduits coupled to both said radiators and to an external water source, said water drainage conduits coupled to both the said radiators and to an external water drainage.

19. A portable breathable fire control system for extinguishing flames and reducing smoke in a building, as in claim 16 wherein, said fluid cooling means comprises a cooling unit said cooling unit having a) a coolant radiator, b) a coolant reservoir, and c) a coolant pump;

said cooling unit coupled on one end to a water inlet conduit and on another end to a water drainage conduit.

* * * * *